US008857669B2

(12) United States Patent
Algora et al.

(10) Patent No.: US 8,857,669 B2
(45) Date of Patent: Oct. 14, 2014

(54) WATER DISPENSER WITH A RESERVOIR SYSTEM AND FAUCET MANIFOLD THEREFOR

(75) Inventors: German Algora, Saint-Sauveur (CA); Tyler Nickerson, Strome (CA); Shusheng Liu, Shenzen (CN); Bohong Zeng, Shenzen (CN)

(73) Assignee: Cardomon Holdings Limited, Kowloon, Hong Kong (CN)

( * ) Notice: Subject to any disclaimer, the term of this patent is extended or adjusted under 35 U.S.C. 154(b) by 1021 days.

(21) Appl. No.: 12/864,957

(22) PCT Filed: Jan. 28, 2009 (Under 37 CFR 1.47)

(86) PCT No.: PCT/CA2009/000069

§ 371 (c)(1), (2), (4) Date: Apr. 21, 2011

(87) PCT Pub. No.: WO2009/094754

PCT Pub. Date: Aug. 6, 2009

(65) Prior Publication Data

US 2011/0303701 A1 Dec. 15, 2011

Related U.S. Application Data

(60) Provisional application No. 61/006,694, filed on Jan. 28, 2008.

(51) Int. Cl.
*B67D 3/00* (2006.01)

(52) U.S. Cl.
CPC ..... *B67D 3/0009* (2013.01); *B67D 3/0038* (2013.01); *B67D 3/0022* (2013.01); *B67D 3/0029* (2013.01)
USPC ..... 222/185.1; 222/146.1

(58) Field of Classification Search
CPC ..... B67D 3/0009
USPC ..... 222/185.1, 146.1, 146.6, 189.09; 62/390, 391, 389, 394, 395, 399, 397
See application file for complete search history.

(56) References Cited

U.S. PATENT DOCUMENTS 2,912,142 A * 11/1959 Schultz ..... 222/129
3,698,603 A * 10/1972 Radcliffe ..... 222/146.1

(Continued)

FOREIGN PATENT DOCUMENTS

CA 2160586 A1 8/1995
JP 11314699 A 11/1999

(Continued)

OTHER PUBLICATIONS

International Search Report: PCT/CA2009/000069.

*Primary Examiner* — Paul R Durand
*Assistant Examiner* — Charles P Cheyney
(74) *Attorney, Agent, or Firm* — Ladas & Parry LLP

(57) ABSTRACT

A water dispenser is disclosed having a housing for a reservoir in communication with a faucet to draw water therefrom. A water bottle is positioned spout-down at the top of the housing or in the top section of the reservoir. Water flows to the faucet via gravity without the use of pumps and the like. The configuration of the reservoir and the positioning of conduits provides to place the faucet closer to the top of the water dispenser again without the use of pumps and the like. The faucet includes separate compartments as well as inlets and outlets so as to divert water towards a variety of water treatment apparatuses such as hot tanks, carbonators, chillers and the like. The faucet includes controllable valves which provide the user to choose between hot, cold, carbonated or otherwise treated water. The faucet and reservoir can form an assembly which can be removed from the housing without tools.

19 Claims, 11 Drawing Sheets

(56) References Cited

U.S. PATENT DOCUMENTS

| | | | | |
|---|---|---|---|---|
| 5,184,476 | A | 2/1993 | Desrosiers et al. | |
| 5,192,004 | A * | 3/1993 | Burrows | 222/146.1 |
| 5,390,826 | A | 2/1995 | Burrows | |
| 5,439,145 | A | 8/1995 | Salkeld et al. | |
| 5,667,103 | A * | 9/1997 | Donselman et al. | 222/129 |
| 5,911,341 | A * | 6/1999 | Donselman et al. | 222/129 |
| 5,979,709 | A | 11/1999 | Liccioni | |
| 5,992,684 | A * | 11/1999 | Russell | 222/1 |
| 2005/0006405 | A1 * | 1/2005 | Tang | 222/146.6 |
| 2005/0028550 | A1 | 2/2005 | Crettet, IV | |
| 2007/0056314 | A1 | 3/2007 | Mali et al. | |
| 2007/0278250 | A1 | 12/2007 | Pittaway et al. | |

FOREIGN PATENT DOCUMENTS

| | | | |
|---|---|---|---|
| WO | 95/11194 | A1 | 4/1995 |
| WO | 98/51970 | A2 | 11/1998 |
| WO | 2006/092783 | A2 | 9/2006 |

* cited by examiner

WATER DISPENSER WITH A RESERVOIR SYSTEM AND FAUCET MANIFOLD THEREFOR

CROSS-REFERENCE TO RELATED APPLICATIONS

The present application claims priority from U.S. Provisional Patent Application No. 61/006,694, filed Jan. 29, 2008.

FIELD OF THE INVENTION

The present invention relates to a liquid dispenser. More specifically, but not exclusively, the present invention relates to a water dispenser with a reservoir system and faucet manifold therefor.

BACKGROUND OF THE INVENTION

Liquid or water dispensers including water coolers are well known devices that that cool and dispense water. Free-standing water coolers include bottles of water placed spout-down into a reservoir within the dispensing machine housing. The water in the reservoir is accessed via a faucet. These devices include faucets for dispensing water in a controlled manner. These devices come in a variety of sizes and vary from table units, intended for occasional use to floor-mounted units intended for heavier use. Some units offer a refrigeration function to chill the water. Usually, these units do not have a place to dump excess water, only offering a small basin to catch minor spills. Some versions also have a second dispenser that delivers heated water that can be used for tea, hot chocolate, or instant coffee.

A drawback of conventional water dispensers is that the faucet is placed too low along the body of the dispensing machine, whereas providing reservoirs that are higher up creates tall and unstable or units. Furthermore, in certain markets there are requirements to sanitize water dispensers. This process is often lengthy and difficult. In addition, hands may touch parts of components that are in contact with water. In this process it often results in recontamination these parts.

OBJECTS OF THE INVENTION

An object of the present invention is to provide a water dispenser

An object of the present invention is to provide a faucet-reservoir assembly for a water dispenser.

An object of the present invention is to provide a faucet device for a water dispenser.

SUMMARY OF THE INVENTION

In accordance with an aspect of the present invention, there is provided a water dispenser comprising:

a housing comprising a top portion thereof for receiving a water bottle spout-down;

a reservoir longitudinally extending within the housing and defining top and bottom ends thereof, the reservoir top end being in fluid communication with the water bottle so as to receive water therefrom thereby filling the reservoir;

a faucet mounted to the housing and being positioned closer to the reservoir top end than to the reservoir bottom end;

a longitudinal conduit in fluid communication at a top end thereof with the faucet and having a bottom end thereof extending to the reservoir bottom end and defining an inlet, wherein water flows from the water bottle into the reservoir via gravity, the water flow pressure causing water to enter the inlet and flow upwardly the longitudinal conduit to be accessed via the faucet.

In accordance with an aspect of the present invention, there is provided a faucet-reservoir assembly for a water dispenser, the faucet-reservoir assembly comprising:

a reservoir comprising a top section thereof defining a top end for receiving a water bottle spout-down and a longitudinally extending bottom section defining a bottom end;

a faucet mounted to the reservoir at a position that is closer to the reservoir top end than to the reservoir bottom end;

a longitudinal conduit in fluid communication at a top end thereof with the faucet and having a bottom end thereof extending to the reservoir bottom end and defining an inlet, wherein water flows from the water bottle into the reservoir via gravity, the water flow pressure causing water to enter the inlet and flow upwardly the longitudinal conduit to be accessed via the faucet.

In accordance with an aspect of the present invention, there is provided a water dispenser comprising:

a housing having a top opening and a lateral opening;

a reservoir being removably mountable to the housing via the top opening and comprising a longitudinally extending reservoir bottom section defining a bottom end and a reservoir top section extending therefrom for receiving a water bottle spout-down, a longitudinal conduit extending at one end thereof from a reservoir opening along the reservoir into the bottom section and defining a conduit inlet at an opposite end thereof; and a faucet being removably mountable to the reservoir about the housing lateral opening and comprising a faucet inlet for being aligned with the reservoir opening.

In accordance with an aspect of the present invention, there is provided a faucet-reservoir assembly for being mounted to a water dispenser having a housing with a top opening and a lateral opening, the faucet-reservoir assembly comprising:

a reservoir being removably mountable to the housing via the top opening and comprising a longitudinally extending reservoir bottom section defining a bottom end and a reservoir top section extending therefrom for receiving a water bottle spout-down, a longitudinal conduit extending at one end thereof from a reservoir opening along the reservoir into the bottom section and defining a conduit inlet at an opposite end thereof; and a faucet being removably mountable to the reservoir about the housing lateral opening and comprising a faucet inlet for being aligned with the reservoir opening.

In accordance with an aspect of the present invention, there is provided a faucet device for being mounted to a water dispenser having a reservoir, the faucet device comprising:

an inlet for being in fluid communication with the reservoir via a conduit;

an outlet for dispensing water;

at least one additional outlet for being mountable to an auxiliary conduit extending from a treatment apparatus; and at least one additional inlet for being mountable to a return longitudinal conduit in extending from the water treatment apparatus.

In accordance with an aspect of the present invention, there is provided a faucet device for a water dispenser, the faucet device comprising:

a main body for containing water therein;

at least two water inlets for providing water to the main body from a reservoir in the water dispenser;

a dispensing outlet for drawing water from the main body;

at least three compartments formed within the main body;

at least two valves mounted between the main body and the dispensing outlet, each valve providing access to water within a respective one of the compartments;

at least one additional outlet in a given compartment; and at least one additional inlet in a a compartment other than the given compartment.

In an illustrative embodiment, there is provided a water dispenser comprising an auxiliary longitudinal conduit extending from the faucet towards a water treatment apparatus, a return longitudinal conduit extending from the water treatment apparatus to the faucet, wherein water flows downwardly via gravity from said faucet to the water treatment apparatus, the water flow pressure from the auxiliary longitudinal conduit causing water in the water treatment apparatus to flow upwardly into the return longitudinal conduit to be accessed via the faucet. In an illustrative embodiment, there is provided a water dispenser comprising at least one additional auxiliary longitudinal conduit extending from the faucet towards at least one additional water treatment apparatus, at least one additional return longitudinal conduit extending from the additional water treatment apparatus to the faucet, wherein water flows downwardly via gravity from the faucet to the additional water treatment apparatus, the water flow pressure from the additional auxiliary longitudinal conduit causing water in the additional water treatment apparatus to flow upwardly into the additional return longitudinal conduit to be accessed via said faucet.

In an illustrative embodiment, the faucet comprises:

an inlet for being in fluid communication with the longitudinal conduit for receiving water therefrom;

an outlet for dispensing water;

at least one additional outlet for being mounted to an auxiliary longitudinal conduit being in fluid communication with a water treatment apparatus; and at least one additional inlet for being mounted to a return longitudinal conduit in fluid communication with the water treatment apparatus, wherein water flows downwardly via gravity from the faucet to the water treatment apparatus, the water flow pressure from the auxiliary longitudinal conduit causing water in the water treatment apparatus to flow upwardly into the return longitudinal conduit to be accessed via said faucet.

In an illustrative embodiment, the faucet comprises at least two valves, wherein one of the valves provides for accessing water from the reservoir bottom section and the other of the valves provides for accessing water other than water in the bottom section reservoir.

In an illustrative embodiment, the faucet comprises:

an outlet for dispensing water;

at least one additional outlet for being mounted to an auxiliary longitudinal conduit extending from a treatment apparatus within the waters dispenser housing; and at least one additional inlet for being mounted to a return longitudinal conduit extending from the water treatment apparatus.

In an illustrative embodiment, there is provided a water dispenser comprising: a housing configured to allow water to flow therein from a water bottle mounted thereto; a longitudinal reservoir defining top and bottom ends thereof and being so mounted to the housing as to extend therein and as to be placed in fluid communication with the water bottle mounted to the housing; and a faucet in fluid communication with the reservoir and mounted to the housing at a longitudinal position that is closer to the top end of the reservoir than the bottom end thereof.

In an illustrative embodiment, there is provided a water dispenser comprising: a housing configured to allow water to flow therein from a water bottle mounted thereto; a longitudinal reservoir defining top and bottom ends thereof and being so mounted to the housing as to extend therein and as to be placed in fluid communication with the water bottle mounted to the housing, the longitudinal top end receiving water, a conduit extending from the top end to about the bottom end and having a bottom opening for receiving water therein; and a faucet in fluid communication with a top opening of the conduit.

In an illustrative embodiment, there is provided a faucet-reservoir assembly for being mounted to a water dispenser, the assembly comprising: a water receiving portion configured to allow water to flow therein from a water bottle mounted thereto; a longitudinal reservoir extending from the water receiving portion and defining an opposite bottom end thereof; and a faucet in fluid communication with the reservoir and being so mountable along the dispenser as to be as to be positioned at longitudinal position that is closer to the water receiving portion that the reservoir bottom end.

In an illustrative embodiment, there is provided a faucet-reservoir assembly for being mounted to a water dispenser, the assembly comprising: a water receiving portion configured to allow water to flow therein from a water bottle mounted thereto; a longitudinal reservoir extending from the water receiving portion and defining an opposite bottom end thereof, a conduit extending inside the reservoir from the top end thereof to about the bottom end and having a bottom opening for receiving water therein; and a faucet in fluid communication with a top opening of the conduit.

In an illustrative embodiment, there is provided a faucet device such as faucet manifold for a water dispenser comprising: at least one water entry, though usually two water entries, a diverting section including compartments, inlets and outlets; a dispensing outlet; valves so as to release water from a given compartment thereof.

In illustrative embodiment, there is provided a reservoir system for a water dispenser that requires the faucet to be higher than the bottom of the reservoir. Hence, water is drawn through a feed tube that extends between the bottom of the reservoir and the faucet for dispensing thereof.

In an illustrative embodiment, there is provided a faucet device such as a faucet manifold for a water dispenser which provides to redirect water to one or more of variety of apparatuses such as a hot tank system or carbonator for sparkling beverages to give but two non-limiting examples.

In an illustrative embodiment, there is provided a water delivery system or dispenser comprising a reservoir, a water bottle receiving assembly and a faucet manifold.

In an illustrative embodiment, there is provided a water dispenser provides for its reservoir to be removed, without tools, in an upward motion. The reservoir is held into place by a lid and/or ring mechanism. A baffle separates the room temperature water or ambient temperature from cold water. A variety of faucet devices such as faucet manifolds can separate and divert or redirect water within the water dispenser so as to provide cold water only, room temperature (ambient) water and cold temperature, hot and cold water or any combination thereof to give but a few non-limiting examples. The connection between the faucet manifold and the reservoir may be by pressure fittings, slide connection, key connection, tube connection or other means. The faucet manifolds includes one or more valves that can be opened and closed to deliver water. In an illustrative embodiment, the faucet manifold can be clipped on to, or attached by any other means to secure it to the chassis or reservoir or both. In an alternative embodiment, the system may have a pump, turbine and/or air pressure.

The terms "faucet" and "faucet device" are used herein interchangeably. The terms "opening", "inlet" or "outlet" may also be interchangeably. These terms are used for indicative purposes within the context of the text. In essence, outlets and inlets are opening and an outlet from a first component to a second component is also an inlet for the second component and vice versa. The terms "auxiliary" and "additional" are used herein only as indications of the amount of a given element or component.

It should be noted that a water dispenser is a also a liquid dispenser and as such the invention is not limited to only water but can be used with other liquids such as juices or soft drinks for example.

Other objects, advantages and features of the present invention will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where.

DETAILED DESCRIPTION OF ILLUSTRATIVE EMBODIMENTS

A first non-restrictive illustrative embodiment of the invention will be described with reference to schematic FIG. 1 so as to present the general features thereof.

Figure 1:
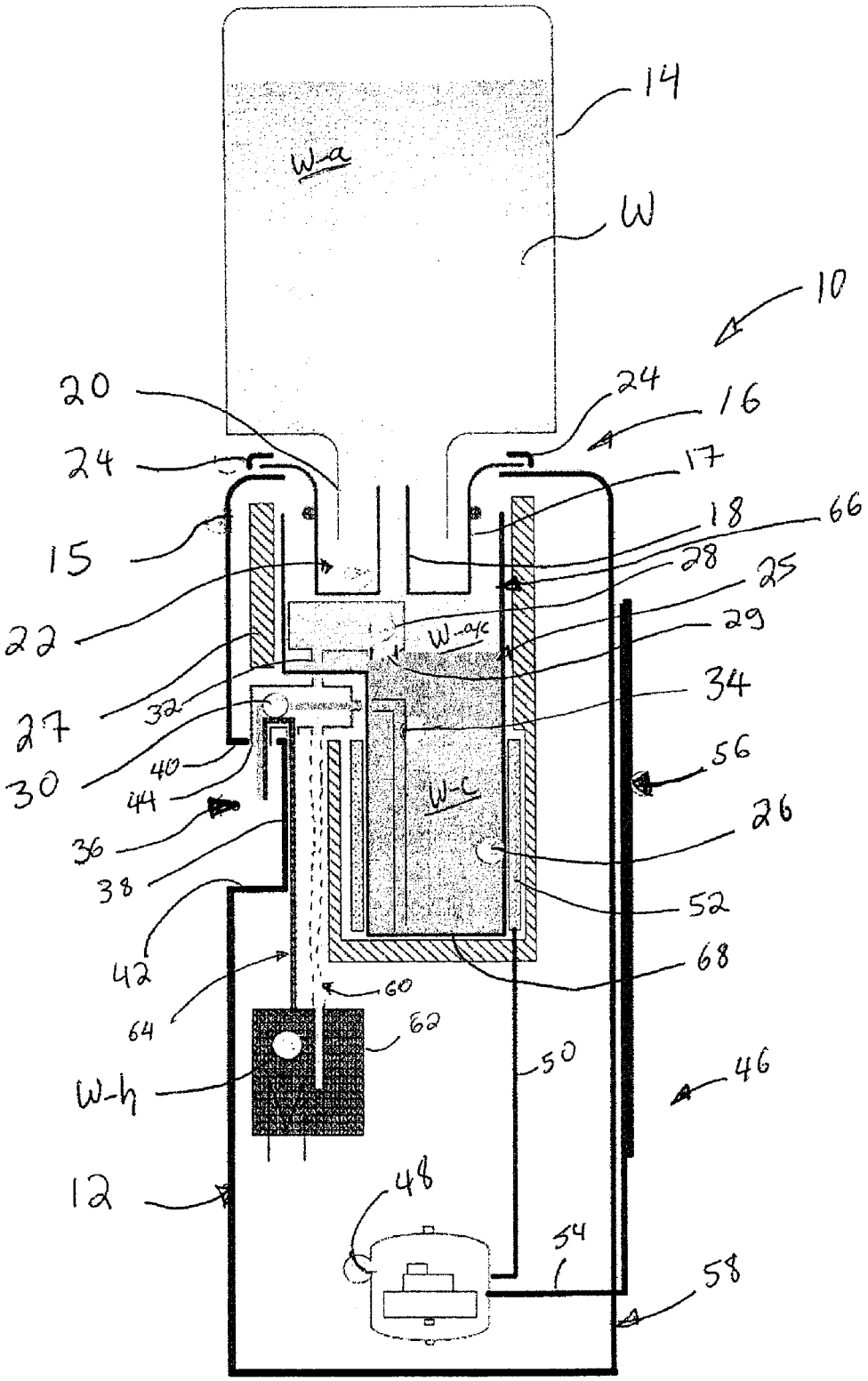
FIG. 1 is a schematic view of a water dispenser in accordance with a non-restrictive illustrative embodiment of the present invention.

FIG. 1 shows a water dispenser 10 comprising a main body or housing 12 and a removable water bottle 14 containing water W.

The housing 12 includes an upper water dispenser cabinet 15 with a top portion 16 defining an open top end for receiving the water bottle 14 in an inverted or spout-down position. More specifically, the top portion 16 includes a water inlet 18 which mates with the spout 20 of the water bottle 14. The water bottle 14 is held in place within an opening 22 defined by water bottle receptacle 17 at the top portion 16 thereby providing a space for the spout 20.

The housing 12 includes a reservoir 25 having a top section 66 thereof being in fluid communication with the inlet 18 and a contiguous bottom reservoir section or basin 26 longitudinally extending within the housing 12. A ring member 24 secures the reservoir 25 in place and serves to receive the water bottle 14 in place. Since the water bottle 14 is an inverted position, the water W contained therein will flow downwardly by gravity into the reservoir 25. The reservoir 25 is enveloped by insulation 27. A separator or baffle 28 is interposed between the inlet 18 and the reservoir basin 26 so as to direct a portion of the water W flowing from the water bottle towards a faucet 30 such as a faucet manifold (of course other faucet devices may be used) via a short conduit 32. A conduit such as a feed tube 34 extends from the faucet manifold 30 deep into the reservoir basin 26.

As is shown in the drawings the reservoir bottom section or 26 is longer and narrower than the top section 66 and the faucet manifold is mounted about a junction between the top and bottom sections 66 and 26 respectively.

The housing 12 provides a lateral opening in the form of a front recessed portion 36 defining an inward back wall 38 interposed between top and bottom shoulders 40 and 42 respectively. The recessed portion 36 provides a water exit space, with the outlet 44 of the faucet manifold 30 being positioned at the top shoulder 40 and the bottom shoulder 42 defining a cup or glass holder. Of course, the skilled artisan will easily contemplate of variety of configurations for the facade of the water dispenser 10 and as such a variety of lateral openings.

The water dispenser 10 includes a refrigeration system 46 comprising a cooling compressor 48 positioned within the housing 12 and linked, via a suction tube connection 50 that allows refrigerant to flow back to the compressor, to a chiller coil 52 surrounding the reservoir basin 26. The compressor 46 is also linked, via a tube connection 54 to a condenser 56 mounted on the back side 58 of the housing 12. Of course, the skilled artisan can contemplate a variety of configurations for cooling the water in the reservoir as is well known in the art.

A long conduit 60 extends from the faucet manifold 30 to a hot tank 62 positioned deep within the housing 12 beneath the reservoir 25 so as to lead water W thereto. A long return conduit 64 extends from the hot tank 62 to the faucet manifold 30, leading hot water thereto.

In operation, water W flows from the water bottle 12 via the spout 20 and inlet 18 into the baffle 28 where it is lead to the reservoir basin 26 via passage 29 so as to fill up the reservoir 25. In other cases, water overflows from the baffle 28 and flows to the reservoir basin 26. As water W continues to flow into the reservoir basin 26 it feeds into the feed tube 34 leading to the faucet manifold 30. Water from the faucet manifold 30 flows downwardly by gravity into conduit 60 thereby filling up the hot tank 62 and rising upwardly, due to the pressure of constant incoming water W, into the return conduit 64 and back to the faucet manifold 30.

The water W in the water bottle 12, generally denoted by reference W-a, is ambient water since it is generally at room temperature. The water W in the reservoir basin 26, generally denoted here by reference W-c, since it is cooled down or chilled by the refrigeration system 46. The water at the top section 66 of the reservoir 25, generally demoted W-a/c, can be a mixture of ambient and cold water. The water W from in the hot tank, generally denoted by reference W-h, is hot water.

Ambient water W-a flows downwardly by gravity into the faucet manifold 30 from the water bottle 12 via the baffle 28 and short conduit 32. The cold W-c flows from the reservoir 26 to the faucet manifold 30 via the feed tube 34 when there is a suitable pressure on the water W in the reservoir about section 66. Hot water W-h flows from the hot tank 62 into the faucet manifold 30 via the return conduit 64 when there is a suitable pressure on the water W in the reservoir about section 66.

The foregoing configuration provides for positioning the faucet manifold 30 at a higher level along the housing 12 which is basically above the position of the bottom 68 of the reservoir basin 26.

As will be explained below, a user can select between, ambient (W-a), cold (W-c) or hot (W-h) water W via the faucet manifold 30.

Figure 2:
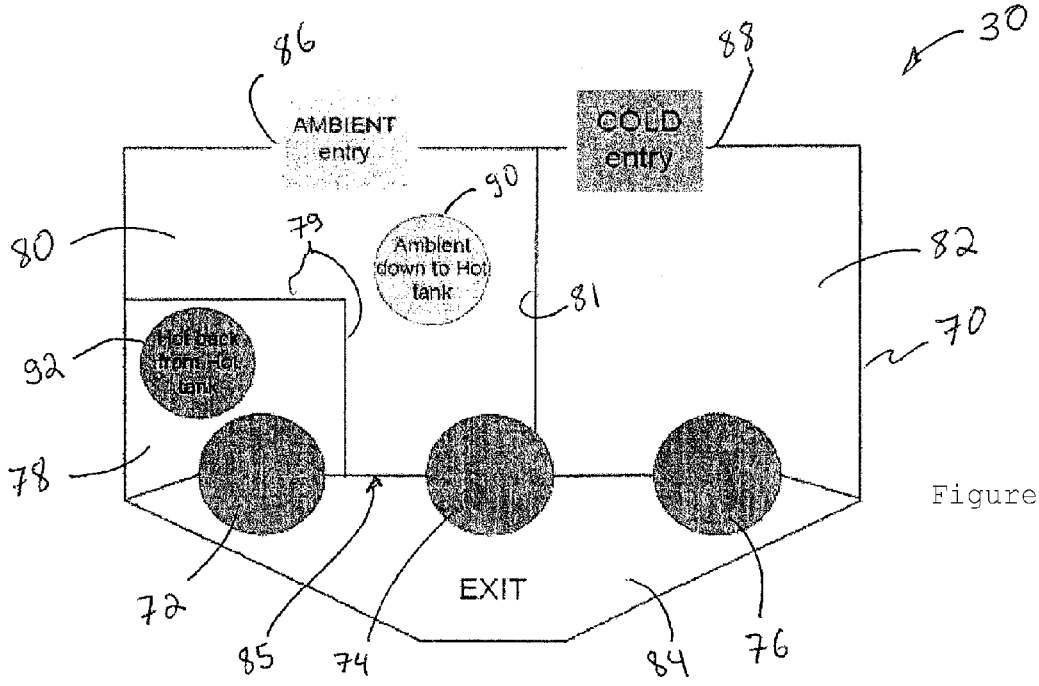
FIGS. 2 to 7 are schematic views of respective non-restrictive illustrative embodiments of the faucet of the present invention.

FIG. 2 is a schematic drawing of the faucet manifold 30.

The faucet manifold 30 includes a main body 70. Three valves 72, 74 and 76 control the flow of water W from three compartments 78, 80 and 82 respectively towards an exit compartment 84 which leads to the water outlet 44 (see FIG. 1). The valves 72, 74 and 76 are open and closed by respective control buttons (not shown in this particular example). Compartment 78 is defined by inner wall 79, exit compartment wall 85 and the main body 70. Compartment 80 is defined by inner walls 79 and 81, exit compartment wall 85 and the main body 70. Compartment 82 is defined by inner wall 81, exit compartment wall 85 and the main body 70.

The main body 70 includes external surrounding wall as well as a floor and a ceiling.

In one non-restrictive embodiment, the separator walls are formed of doubled walls, i.e. a pair of adjacent wall segments spaced apart to contain air therebetween which acts as insulation thereby avoiding that the temperature of a given compartment affect the other adjacent compartment.

Ambient water W-a enters compartment 80 via an ambient water entry 86 whereas cold water W-c enters compartment 82 via a cold water entry 88. The ambient water W-a in compartment 80 flows downwardly by gravity via inlet 90 towards the hot water tank water tank 62 where it is heated and then flows upwardly as hot water W-h therefrom into compartment 78 via outlet 92. In this way, compartment 78 is filled with hot water W-h, compartment 80 is filled with ambient water W-a and compartment 82 is filled with cold water W-c. As such, the user can access hot water W-h, by opening valve 72, ambient water W-a by opening valve 74 and cold water W-c by opening valve 76.

With reference to FIGS. 3 to 7, various non-restrictive illustrative embodiments of alternative faucet devices such as faucet manifolds within the context of the present invention will now be described so as to further exemplify the present invention and by no means limit the scope thereof.

Figure 3:
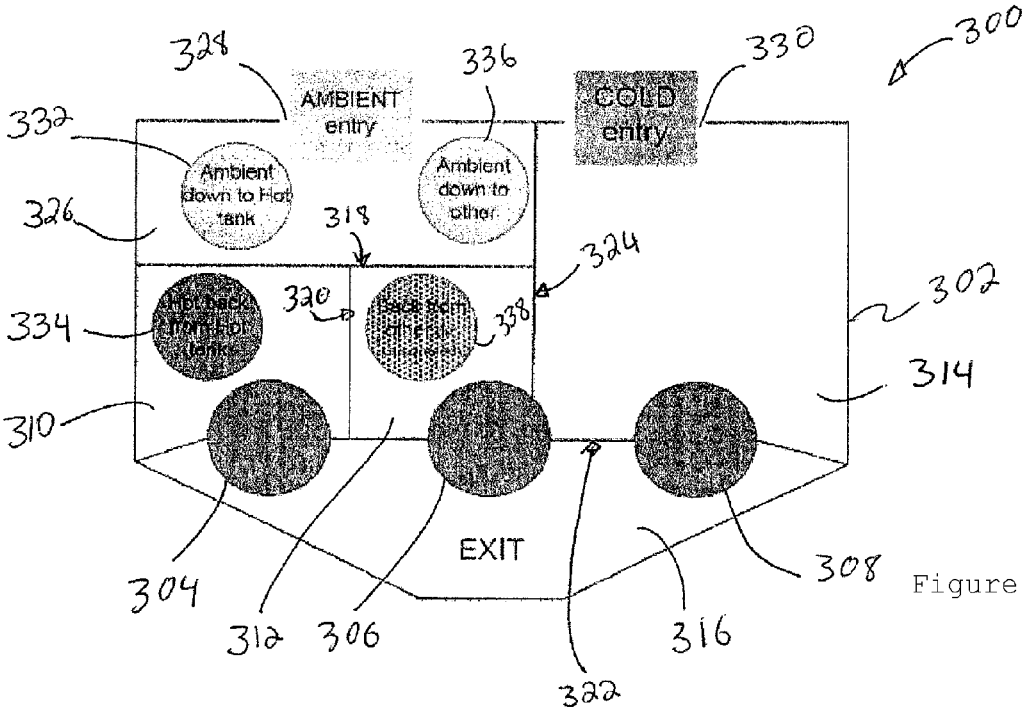

FIG. 3 shows a faucet manifold 300 having a main body 302. Three valves 304, 306 and 308 respectively control the flow of water from three compartments 310, 312 and 314 towards the exit compartment 316. Compartment 310 is defined by inner walls 318 and 320, exit compartment wall 322 and the main body 302. Compartment 312 is defined by inner walls 318, 320 and 324, exit compartment wall 322 and the main body 302. Compartment 314 is defined by inner wall 324, exit compartment wall 322 and the main body 302. A fourth compartment 326 which is not in communication with a valve is defined by the main body 302, and inner walls 318 and 324.

Ambient water enters compartment 326 via an ambient water entry 328, whereas cold water enters compartment 314 via a cold water entry 330. Ambient water in compartment 326 flows towards a hot tank via inlet 332 for heating thereof and hot water flows into compartment 310 via outlet 334. Ambient water in compartment 326 also enters inlet 336 where it is brought to another apparatus, such as a carbonator for example, to then flow upwardly (similarly to the process explained above for hot water W-h) as carbonated water into compartment 312 via outlet 338. In this way, compartment 310 is filled with hot water, compartment 312 is filled with carbonated water, and compartment 314 is filled with cold water all of which are accessible by respectively opening valves 304, 306 and 308.

Of course, instead of a carbonating unit, other apparatuses can be used such as an additional heater for providing hot water of a different temperature, or an additional cooler for providing cold or cool water of a different temperature or a water filter. The skilled artisan can contemplate a variety of suitable and desirable apparatuses for treating the water within the context of the present invention.

Figure 4:
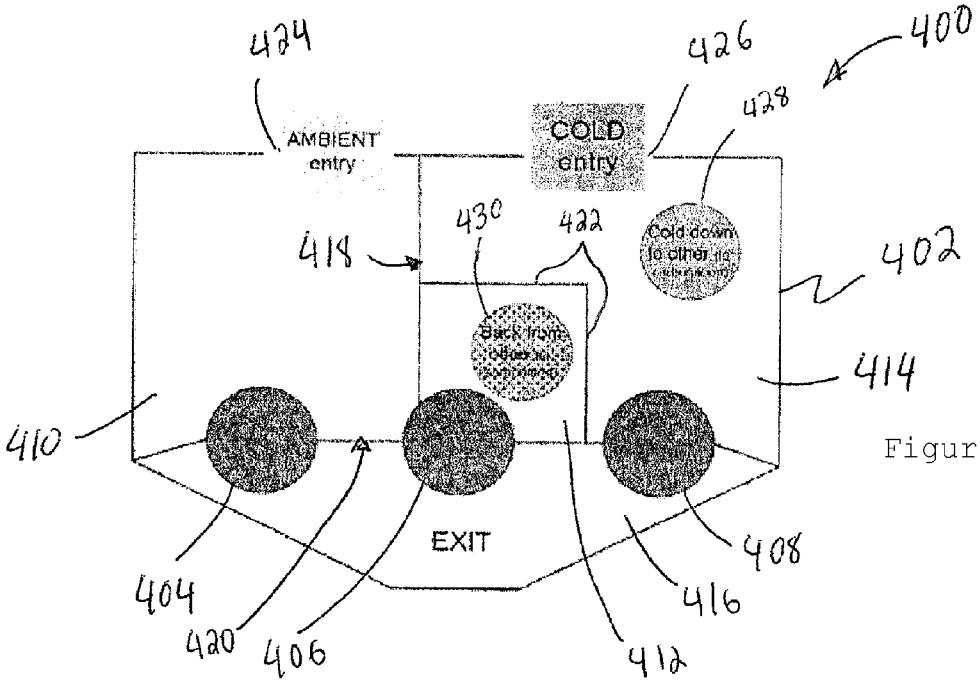

FIG. 4 shows a faucet manifold 400 having a main body 402. Three valves 404, 406 and 408 respectively control the flow of water from three compartments 410, 412 and 414 towards the exit compartment 416. Compartment 410 is defined by inner wall 418, exit compartment wall 420 and the main body 402. Compartment 412 is defined by inner walls 418 and 422, and the exit compartment wail 420. Compartment 414 is defined by inner walls 418 and 422, and the exit compartment wall 420.

Ambient water enters compartment 410 via an ambient water entry 424, whereas cold water enters compartment 414 via a cold water entry 426. Cold water in comportment 414 flows towards another apparatus for treatment (such as a carbonating unit for example) via inlet 428 to be returned upwardly to compartment 412 via outlet 430. In this way, compartment 410 is filled with ambient water, compartment 412 is filled with cold carbonated or otherwise treated water, and compartment 414 is filled with cold water all of which are accessible by respectively opening valves 404, 406 and 408.

Figure 5:
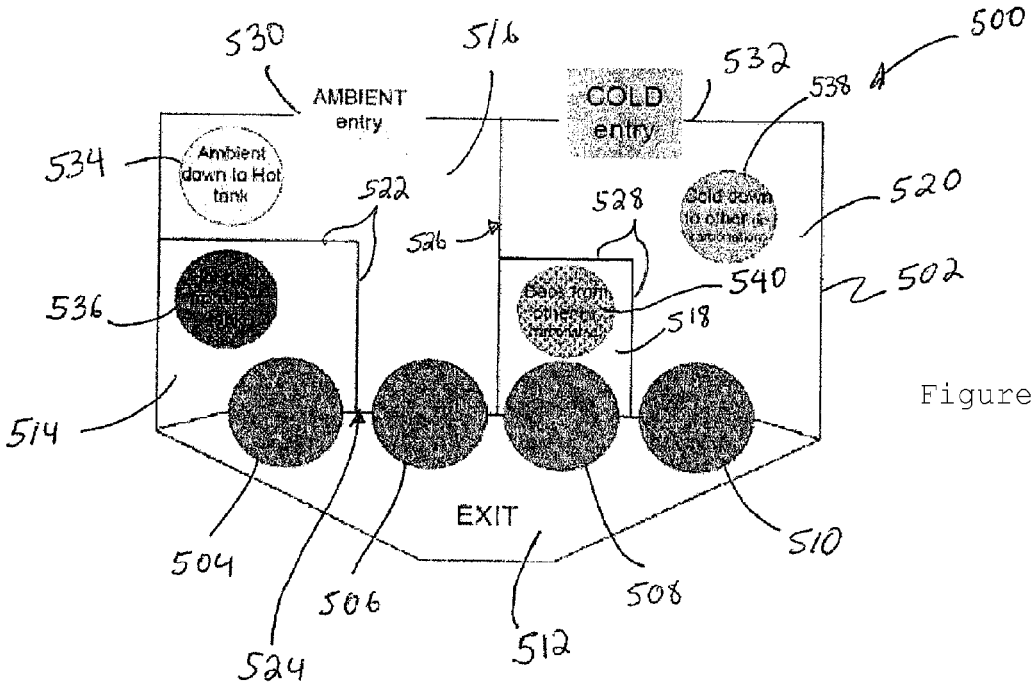

FIG. 5 shows a faucet manifold 500 having a main body 502 and including four valves 504, 506, 508, and 510 for respectively controlling the flow of water into the exit compartment 512 from four compartments 514, 516, 518 and 520. Compartment 514 is defined by inner walls 522, the main body 502 and the exit compartment wall 524. Compartment 516 is defined by the inner walls 522 and 526, the main body 502 and the exit compartment wall 524. Compartment 518 is defined by inner walls 526 and 528 as well as the exit compartment wall 524. Compartment 520 is defined by inner walls 526 and 528, by exit compartment wall 524 and by the main body 502.

Ambient water enters compartment 516 via entry 530 and cold water enters compartment 520 via entry 532. Ambient water within compartment 516 flows downwardly to the hot tank via inlet 534 to upwardly return as hot water into compartment 514 via outlet 536. Cold water within compartment 520 flows downwardly to another apparatus (such as carbonating unit or filter) via inlet 538 for carbonation or other treatment thereof and upwardly returns as cold carbonated or otherwise treated water into compartment 518 via outlet 540. In this way, compartment 514 is filled with hot water, compartment 516 is filled with ambient water, compartment 518 is filled with cold carbonated or otherwise treated water and compartment 520 is filled with cold water which can be selectively accessed by the user by respectively opening valves 504, 506, 508 and 510.

Figure 6:
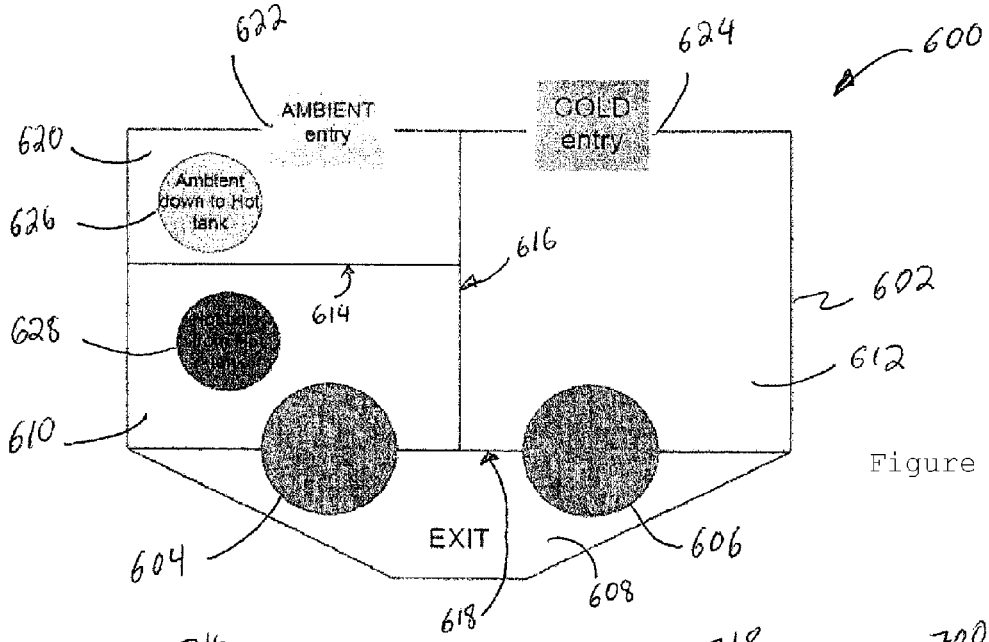

FIG. 6 shows a faucet manifold 600 having a main body 602 and two valves 604 and 606 which control water flow into the exit compartment 608 for access thereof from compartments 610 and 612 respectively. Compartment 610 is defined by the main body 602, and a pair of inner walls 614 and 616 as well as the exit compartment wall 618. Compartment 612 is defined by inner wail 616, exit compartment wall 618 and the main body 602. A third compartment 620 is defined by inner walls 614 and 616 and by the main body 602.

Ambient water enters compartment 620 via entry 622 and cold water enters compartment 612 via entry 624. Ambient water within compartment 620 flows downwardly to a hot tank for heating thereof via inlet 626 to flow upwardly as hot water within compartment 610 via outlet 628. In this way, compartment 610 is filled with hot water while compartment 612 is filled with cold water.

Figure 7:
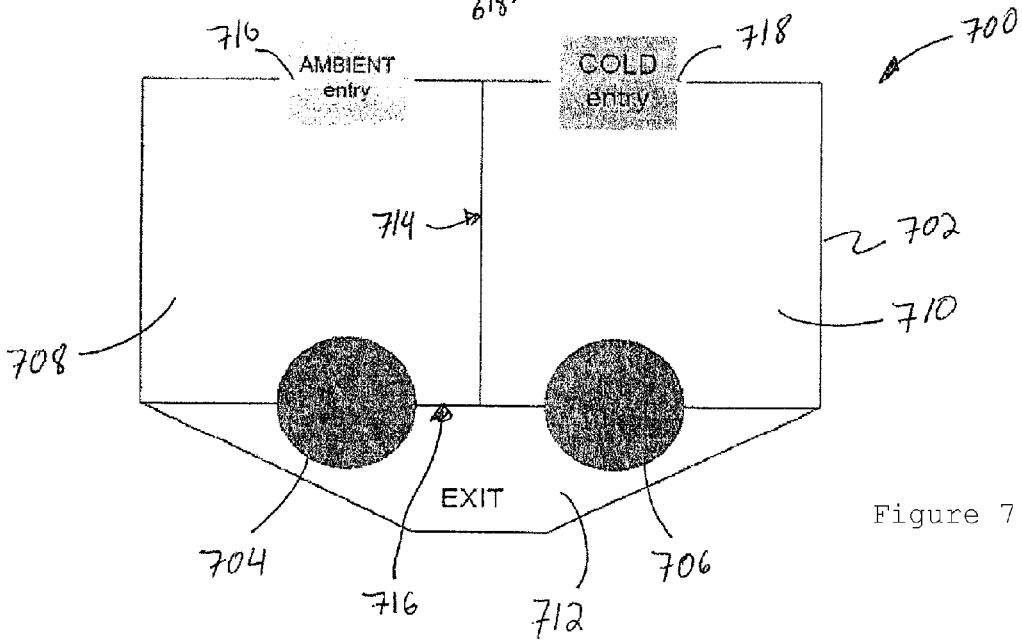

FIG. 7 shows a faucet manifold 700 having a main body 702 with two valves 704 and 706 for respectively controlling water flow from two compartments 708 and 710 into the exit compartment 712. Compartments 708 and 710 are defined by the main body 702, a separator wall 714 and respectively receive ambient and cold water via respective entries 716 and 718 allowing the user to access the ambient or cold water via valves 704 and 706 respectively.

It should be noted that the various features of illustrative embodiments 30, 300, 400, 500, 600 and 700 of the faucet manifold can be combined in a variety of ways and can be provided in a variety of configurations within the context of the present invention as will be readily understood by the skilled artisan.

FIGS. 8 to 14 show another non-restrictive illustrative embodiment of the present invention.

FIGS. 8 to 14 show a faucet-reservoir assembly 100 for a water dispenser (not shown)

Figure 8:
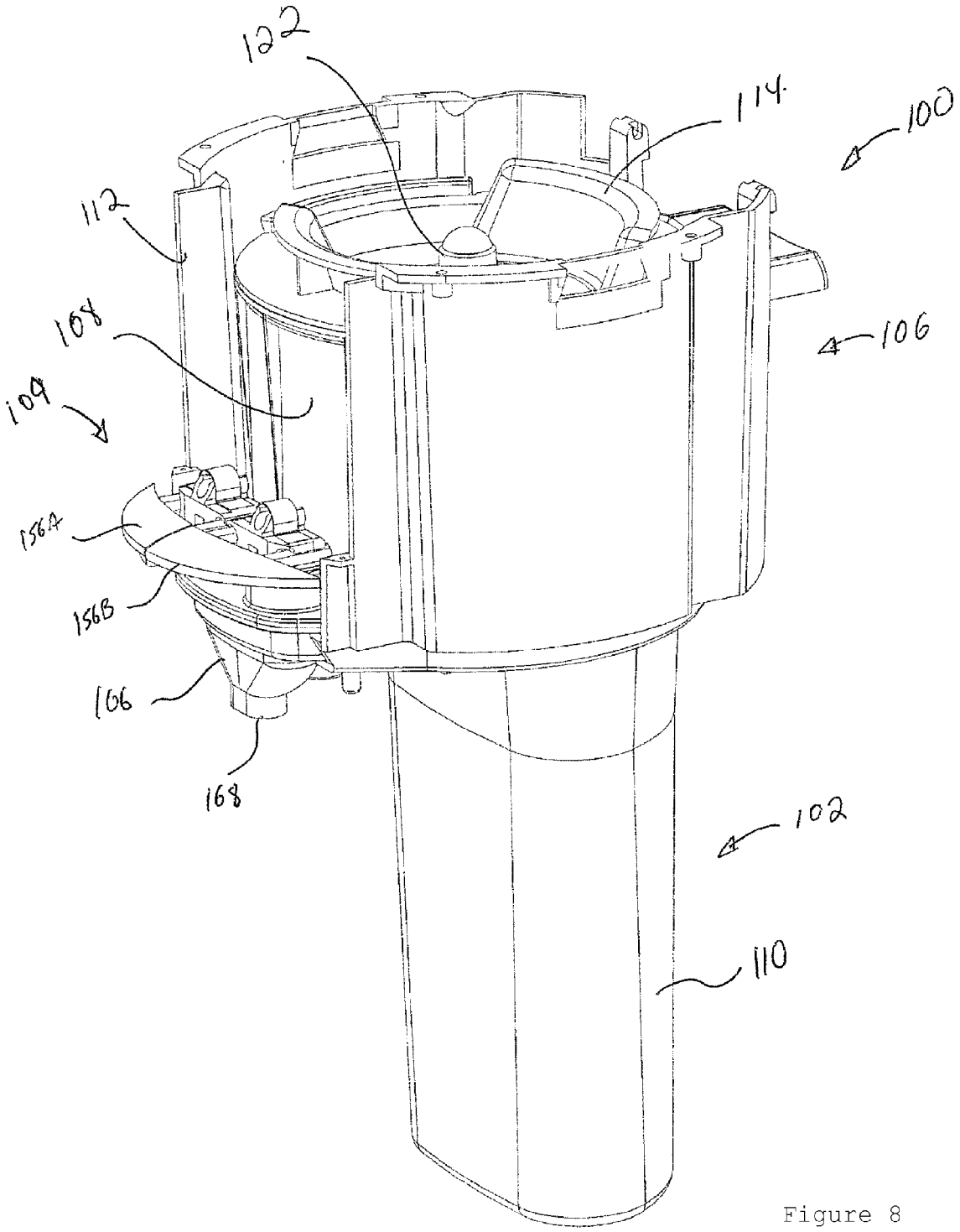
FIG. 8 is a perspective view of the faucet-reservoir assembly in accordance with a non-restrictive illustrative embodiment of the invention.
Figure 9:
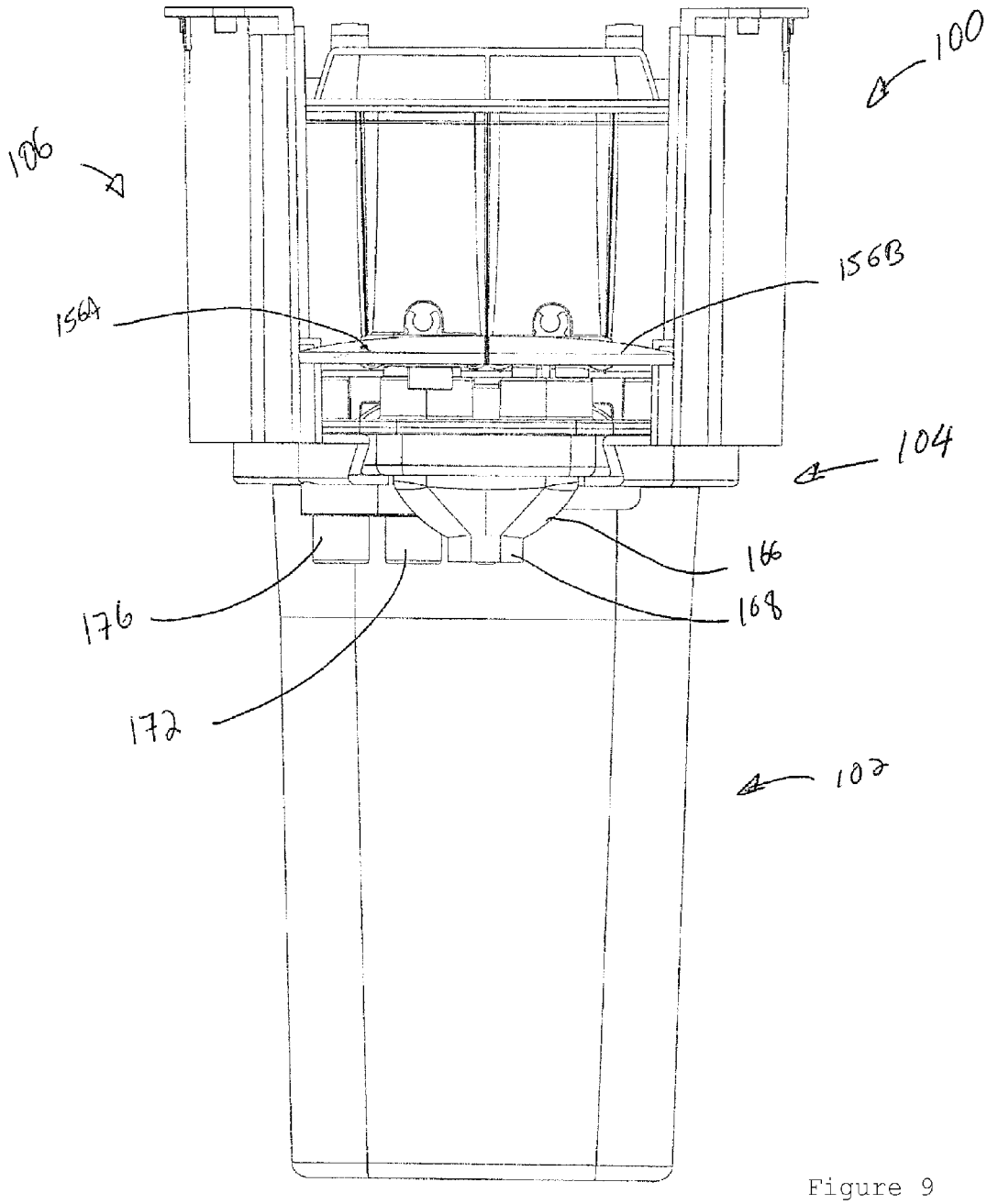
FIG. 9 is front elevation view of the faucet-reservoir assembly of FIG. 8.

With particular reference to FIGS. 8 and 9, the faucet-reservoir assembly 100 includes a reservoir 102, a faucet device such as a faucet manifold 104 and a water receiving assembly 106.

Figure 13:
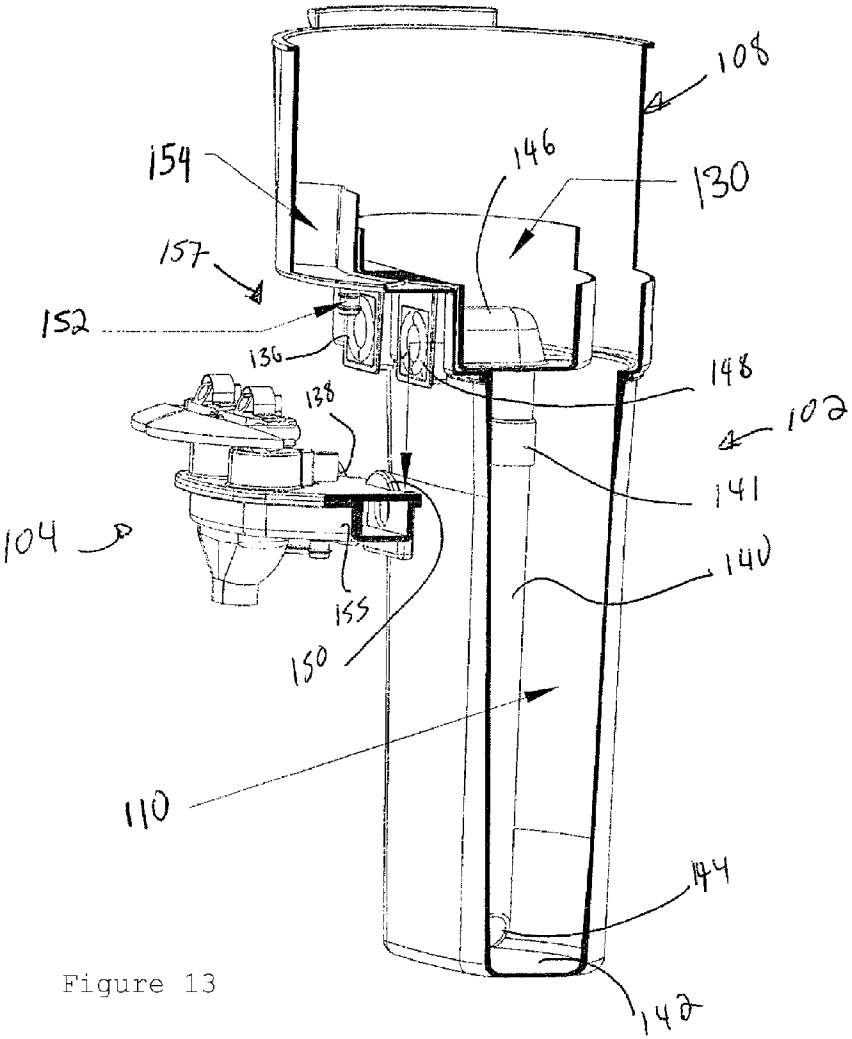
FIG. 13 is a partial and broken disassembled perspective view of the faucet-reservoir assembly of FIG. 8.
Figure 14:
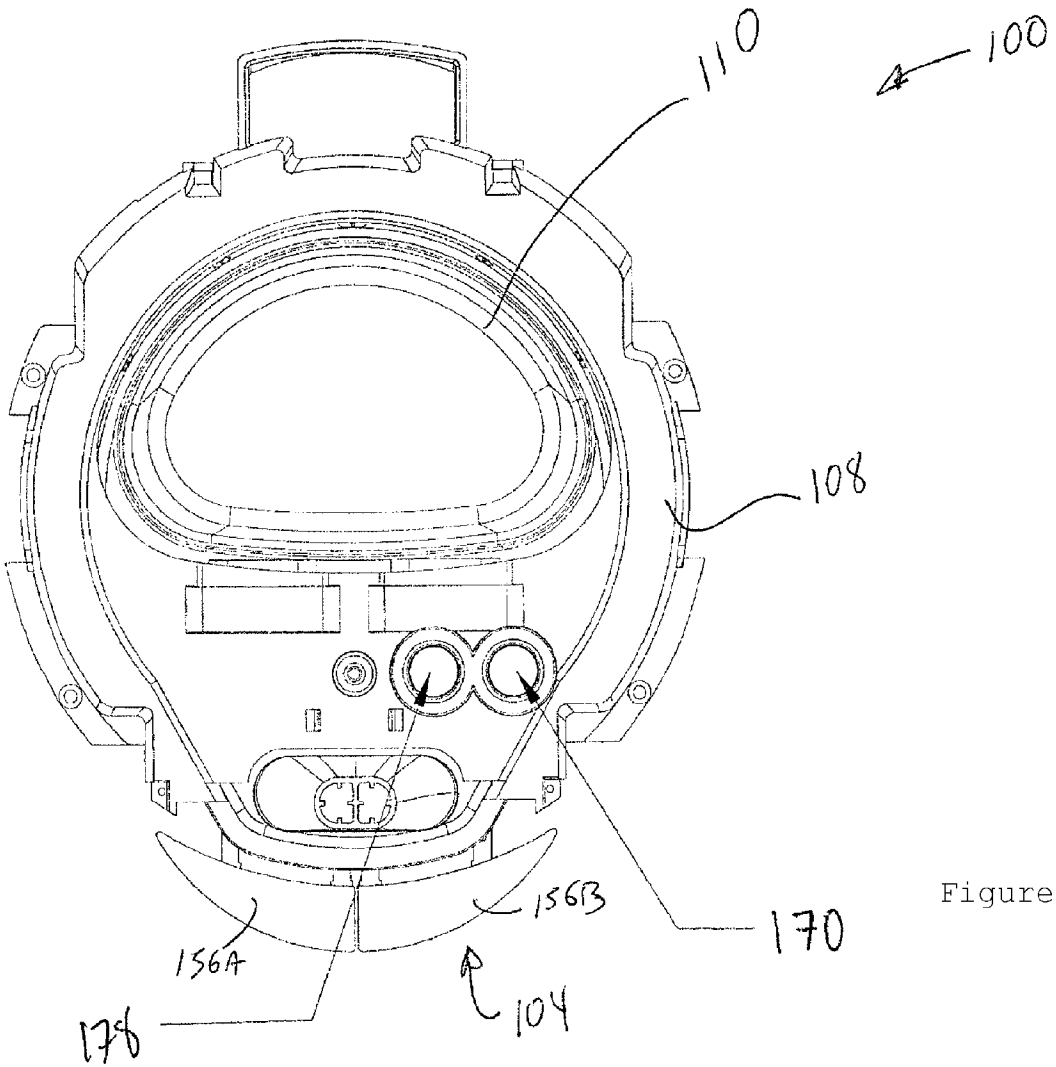
FIG. 14 is a top view of the faucet mounted to the top section of the reservoir in accordance with a non-restrictive illustrative embodiment of the invention.

Briefly, turning to FIG. 13, the reservoir 102 includes a top section 108 and a reservoir bottom section in the form of longitudinally extending basin 110.

Figure 10:
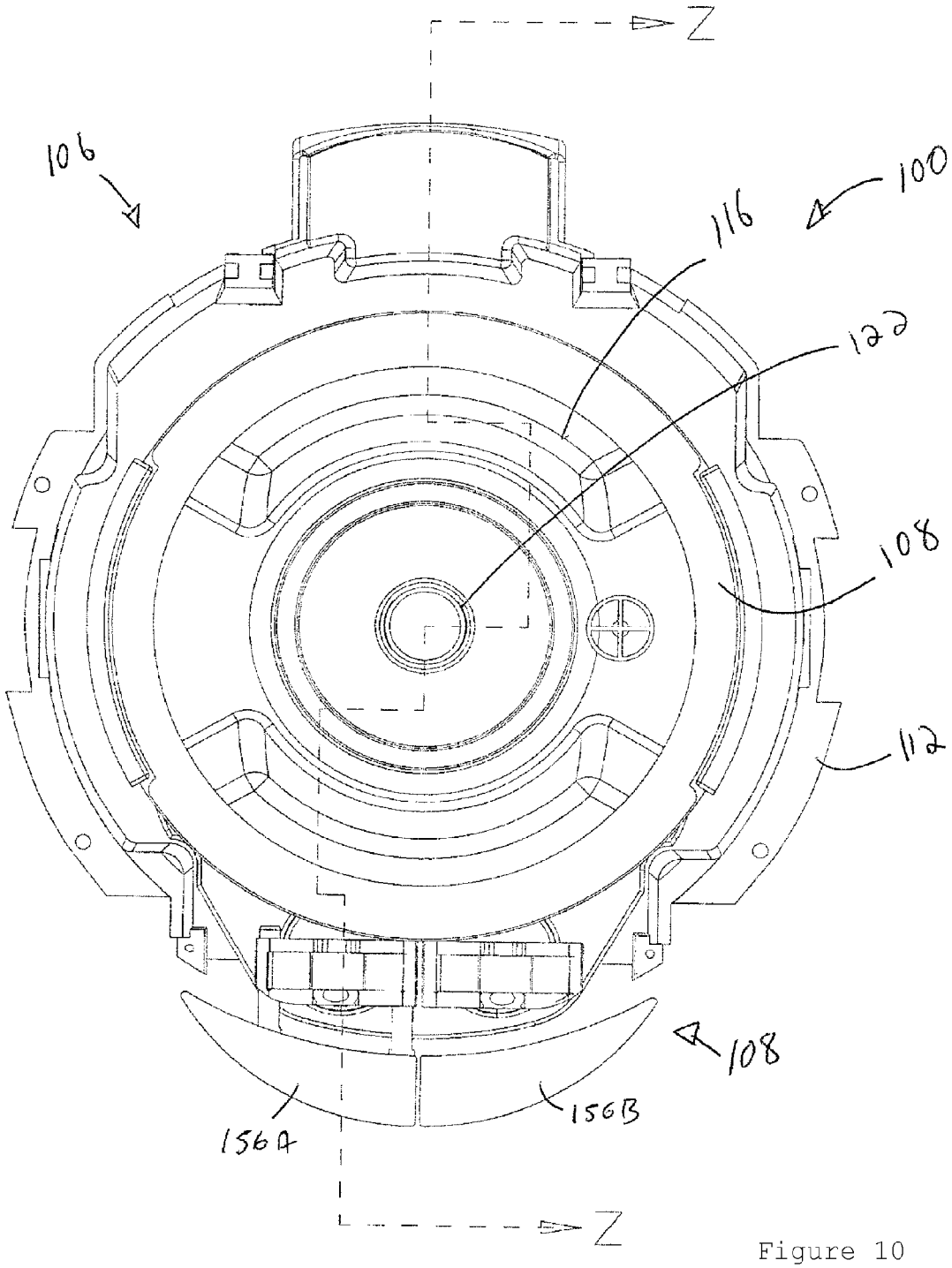
FIG. 10 is a top view of the faucet-reservoir assembly of FIG. 8.
Figure 11:
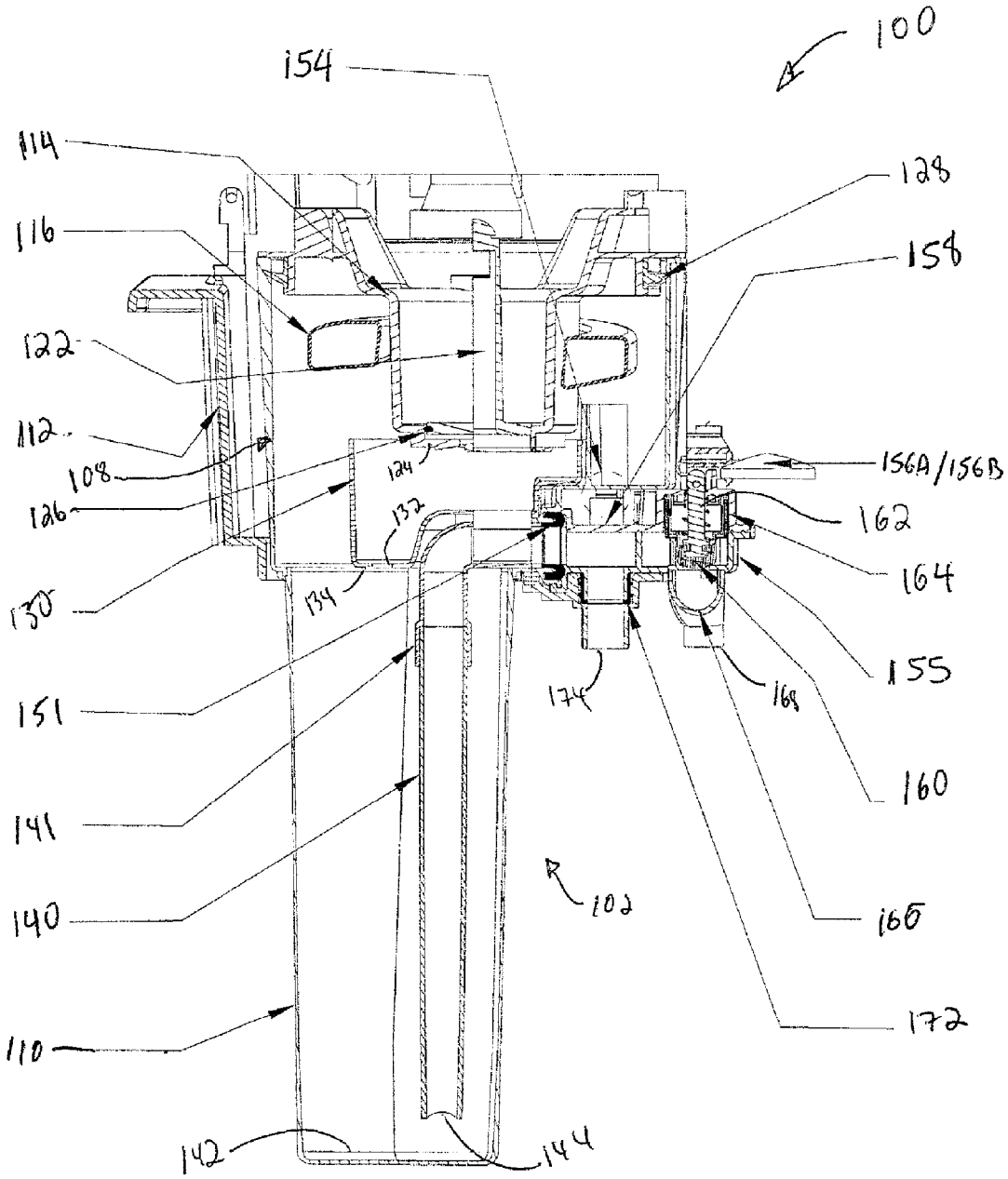
FIG. 11 is a side sectional view along the line Z-Z of FIG. 10.
Figure 12:
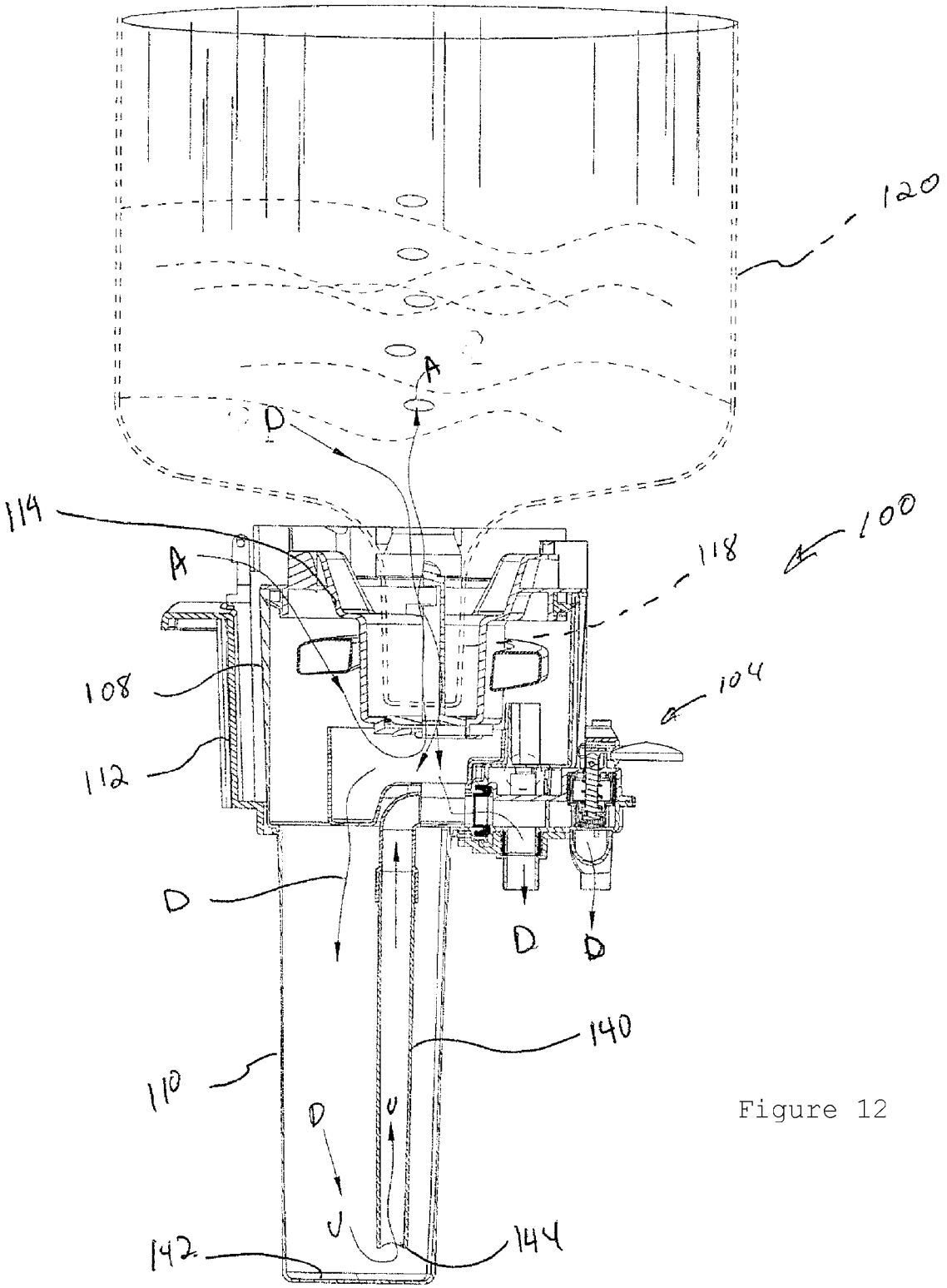
FIG. 12 is the view of FIG. 11 including a schematic water bottle in stippled line.

With respect to FIGS. 10, 11 and 12 the water receiving assembly 106 includes a shell casing 112 for receiving the reservoir top section 108 therein. A water bottle cup-like receptacle 114 is positioned within the top reservoir section 108 and held in position by seal 116. The water bottle receptacle 114 provides a space for receiving the spout 118 of an inverted water bottle 120 therein. A hollow tubular pin member 122 protrudes from the base 124 of the receptacle 114 and is sealed thereto via a seal ring 126. The hollow tubular pin member 122 is fitted within the spout and provides an opening for allowing air to go into the bottle as shown by the arrow A (FIG. 12) and water to flow downwardly therein towards the reservoir basin 110 or be diverted as shown by arrows D.

A baffle 130 (see also FIG. 13) is in fluid communication with the hollow tubular pin member 122 thereby diverting water towards the faucet manifold 104 or allowing water to flow towards the reservoir 102 via a passageway 132 at its base 134. As shown in FIG. 13, the baffle 130 is contiguous with an opening 136 formed in the top reservoir section 108 and which is in fluid communication with a corresponding opening 138 of the faucet manifold 104 thereby allowing water to flow thereto.

The reservoir basin 110 includes a conduit or feed tube 140 mounted to a guide elbow 141 and extending all the way to the bottom end 142 of the reservoir basin 110. The feed tube 140 includes an inlet 144 at one end thereof and defined a conduit that extends all the way up towards a short conduit 146 positioned within the baffle 130 that leads to an opening 148 formed in the reservoir top section 108. This opening 148 is placed in fluid communication with the corresponding opening 150 of the faucet manifold 104. The foregoing connection can be sealed with a seal member 151. Hence, as shown by arrows U, water enters via inlet 144 and moves upwardly along the feed tube 140.

As show in FIGS. 11 and 13, the reservoir top section 108 includes a tube 152 for releasing hot water as well as hot water backflow 154.

With particular reference to FIGS. 8, 9, 11, 13 and 14, the faucet manifold 104 includes a base 155 removable mountable by a mutual slide fit with a portion 157 of the top reservoir section 108 (see FIG. 13). The faucet manifold 104 includes levers 156A and 156B for releasing water flowing from a diverting section 158 comprising compartments as explained above for FIGS. 2 to 7. A lever 156A or 156B provides for opening or closing valve 160 by moving spring-biased rod 162 placed within a silicon ring 164 thereby allowing water to enter and exit compartment 166 and flow out of the outlet 168 allowing the user to draw water.

The faucet manifold 104 includes a water inlet 170 that leads to a short conduit 172 having an outlet 174 in order to be connected to an additional conduit (not shown) so as to send water to an apparatus such as a hot tank, for example, and return as hot water through another conduit (not shown) via a short conduit 176 which leads to the faucet manifold 104 via outlet 178.

The faucet-reservoir assembly 100 can be easily placed within a water dispenser or removed therefrom. When removing the assembly 100, first, the receptacle 114 along with the pin 122 and the reservoir 102 are moved upwardly, detaching the reservoir 102 from its slide fit with the faucet manifold 104. The faucet manifold 104 can then be detached from the water dispenser since it can be accessed from the internal space left by the reservoir 102.

In operation, water flows from the spout 118 into the pin 122 and into the baffle 130 which leads to the reservoir basin 110 and then flows upwardly into the feed tube 140 which leads to the faucet manifold 104. As previously explained, the faucet manifold can be separated and diverted for carbonation, heating or other operations.

The water dispensers of the invention may come in a variety of shapes, sizes and designs and may include more than one reservoir so as to be configured to be mounted by more than one water bottle. The water dispensers may also be liquid dispensers and the skilled artisan will readily appreciate. As such the same structure used for dispensing can also be used for juice, soft drinks and other liquids. The faucets described herein can also be positioned on a water dispenser near the bottom of the reservoir in other non-limiting examples. It should be noted that the various components and features of the water dispensers, faucet-reservoir assemblies and faucets described above can be combined in a variety of ways so as to provide other non-illustrated embodiments within the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention.

What is claimed is:

1. A water dispenser comprising:

a housing comprising a top portion thereof for receiving a water bottle spout-down;

an faucet-reservoir assembly in the form of a single integrated unit comprising a contiguous rigid body structure and being removably mounted to said housing and comprising:

a reservoir longitudinally extending within said housing and defining top and bottom ends thereof, said reservoir top end being in fluid communication with the water bottle so as to receive water therefrom thereby filling said reservoir, said reservoir comprises a top section having said reservoir top end and a bottom section extending from said top section and having said reservoir bottom end, said reservoir bottom section being longer and narrower than said reservoir top section, said top section defining a bottom outer surface thereof; and a faucet extending from said reservoir top section about a junction between said reservoir top and bottom sections and being positioned closer to said reservoir top end than to said reservoir bottom end, said faucet having an outlet beneath said to section bottom outer surface;

a longitudinal conduit in fluid communication at a top end thereof with said faucet and having a bottom end thereof extending to said reservoir bottom end and defining an inlet; and an auxiliary longitudinal conduit extending from said faucet towards a water treatment apparatus, a return longitudinal conduit extending from said water treatment apparatus to said faucet, wherein water flows from the water bottle into said reservoir via gravity, the water flow pressure causing water to enter said inlet and flow upwardly said longitudinal conduit to be accessed via said faucet, wherein water flows downwardly via gravity from said faucet to said water treatment apparatus, the water flow pressure from said auxiliary longitudinal conduit causing water in said water treatment apparatus to flow upwardly into said return longitudinal conduit to be accessed via said faucet.

2. A water dispenser according to claim 1, wherein said reservoir top section receives the water bottle therein.

3. A water dispenser according to claim 1, further comprising a baffle for diverting water from said reservoir top section to said faucet.

4. A water dispenser according to claim 1, wherein said reservoir bottom section is chilled so as to provide cold water.

5. A water dispenser according to claim 1, wherein said water treatment apparatus is at a position that is lower than said reservoir bottom end.

6. A water dispenser according to claim 1, wherein said water treatment apparatus comprises a hot water tank.

7. A water dispenser according to claim 1, wherein said water treatment apparatus comprises a carbonator.

8. A water dispenser according to claim 1, further comprising at least one additional auxiliary longitudinal conduit extending from said faucet towards at least one additional water treatment apparatus, at least one additional return longitudinal conduit extending from said additional water treatment apparatus to said faucet, wherein water flows downwardly via gravity from said faucet to said additional water treatment apparatus, the water flow pressure from said additional auxiliary longitudinal conduit causing water in said additional water treatment apparatus to flow upwardly into said additional return longitudinal conduit to be accessed via said faucet.

9. A water dispenser according to claim 1, wherein said faucet comprises at least two valves, wherein one of said valves provides for accessing water from said water reservoir bottom section and the other of said valves provides for accessing water other than water in said bottom section reservoir.

10. A water dispenser according to claim 1, wherein said reservoir top end provides for atmospheric pressure to act on the water in said reservoir.

11. A faucet-reservoir for a water dispenser, said faucet-reservoir assembly comprising:

an integrated unit comprising a continuous rigid body structure and comprising:

a reservoir comprising a top section thereof defining a top end for receiving a water bottle spout-down and a longitudinally extending bottom section defining a bottom end, said reservoir comprises a top section having said reservoir top end and a bottom section extending from said top section and having said reservoir bottom end said reservoir bottom section being longer and narrower than said reservoir top section, said top section defining a bottom outer surface thereof; and a faucet extending from said reservoir top section about a junction between said reservoir top and bottom sections and being positioned closer to said reservoir top end than to said reservoir bottom end, said faucet having an outlet beneath said to section bottom outer surface; and a longitudinal conduit in fluid communication at a top end thereof with said faucet and having a bottom end thereof extending to said reservoir bottom end and defining an inlet, wherein water flows from the water bottle into said reservoir via gravity, the water flow pressure causing water to enter said inlet and flow upwardly said longitudinal conduit to be accessed via said faucet.

12. A faucet-reservoir assembly according to claim 2, wherein said reservoir top section receives the water bottle therein.

13. A faucet-reservoir assembly according to claim 12, wherein said reservoir comprises a top casing extending upwardly from said reservoir bottom section, said reservoir top section being mounted within said casing.

14. A faucet-reservoir assembly according to claim 13, wherein said reservoir top section is removably mountable within said casing.

15. A faucet-reservoir assembly according to claim 12, wherein said reservoir top section comprises a receptacle for receiving the water bottle spout-down.

16. A faucet-reservoir assembly according to claim 15, wherein said receptacle comprises a hollow tubular pin member protruding therefrom to be fitted within the spout of the bottle so as to provide air therein.

17. A faucet-reservoir assembly according to claim 11, further comprising a baffle mounted between said faucet and said reservoir top section for diverting water from said reservoir top section to said faucet.

18. A faucet-reservoir assembly according to claim 11, wherein said faucet is removably mounted to said reservoir.

19. A faucet-reservoir assembly according to claim 11, wherein said faucet comprises:

an inlet for being in fluid communication with said longitudinal conduit for receiving water therefrom;

an outlet for dispensing water;

at least one additional outlet for being mounted to an auxiliary longitudinal conduit being in fluid communication with a water treatment apparatus; and at least one additional inlet for being mounted to a return longitudinal conduit in fluid communication with the water treatment apparatus, wherein water flows downwardly via gravity from said faucet to the water treatment apparatus, the water flow pressure from the auxiliary longitudinal conduit causing water in the water treatment apparatus to flow upwardly into the return longitudinal conduit to be accessed via said faucet.

* * * * *